US009291046B2

(12) United States Patent
Ramakrishnan et al.

(10) Patent No.: US 9,291,046 B2
(45) Date of Patent: Mar. 22, 2016

(54) DUAL OR TWIN-WELL COMPLETION WITH WETTABILITY ALTERATION FOR SEGREGATED OIL AND WATER PRODUCTION

(75) Inventors: Terizhandur S. Ramakrishnan, Boxborough, MA (US); Paul S. Hammond, Bourn (GB); John M. Cook, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 695 days.

(21) Appl. No.: 13/191,995

(22) Filed: Jul. 27, 2011

(65) Prior Publication Data

US 2013/0025856 A1 Jan. 31, 2013

(51) Int. Cl.
*E21B 43/38* (2006.01)

(52) U.S. Cl.
CPC ..... *E21B 43/38* (2013.01); *E21B 43/385* (2013.01)

(58) Field of Classification Search
None
See application file for complete search history.

(56) References Cited

U.S. PATENT DOCUMENTS

| | | | | | |
|---|---|---|---|---|---|
| 3,032,499 | A | * | 5/1962 | Brown | 507/251 |
| 3,172,471 | A | * | 3/1965 | Warren | 166/281 |
| 3,368,624 | A | * | 2/1968 | Heuer, Jr. et al. | 166/305.1 |
| 3,550,696 | A | * | 12/1970 | Kenneday | 175/25 |
| 4,296,810 | A | | 10/1981 | Price | |
| 4,444,265 | A | * | 4/1984 | Schmidt | 166/295 |
| 4,532,052 | A | * | 7/1985 | Weaver et al. | 507/222 |
| 4,928,763 | A | * | 5/1990 | Falk | 166/285 |
| 5,002,127 | A | * | 3/1991 | Dalrymple et al. | 166/295 |
| 5,150,754 | A | * | 9/1992 | Phelps et al. | 166/294 |
| 5,314,019 | A | * | 5/1994 | Honarpour | 166/270 |
| 5,335,732 | A | * | 8/1994 | McIntyre | 166/313 |
| 5,476,145 | A | * | 12/1995 | Sengul et al. | 166/295 |
| 5,896,928 | A | * | 4/1999 | Coon | 166/373 |
| 5,992,524 | A | * | 11/1999 | Graham | 166/313 |

(Continued)

FOREIGN PATENT DOCUMENTS

| | | | |
|---|---|---|---|
| RU | 2211311 | C2 | 8/2003 |
| RU | 2337234 | C1 | 10/2008 |
| SU | 173169 | A | 12/1965 |

OTHER PUBLICATIONS

Veil et al.; A White Paper Describing Produced Water from Production of Crude Oil, Natural Gas, and Coal Bed Methane; Jan. 2004; Argonne National Laboratory; pp. 1-87; http://www.circleofblue.org/waternews/wp-content/uploads/2010/08/prodwaterpaper1.pdf.*

(Continued)

*Primary Examiner* — Angela M DiTrani
*Assistant Examiner* — Anuradha Ahuja
(74) *Attorney, Agent, or Firm* — Jakub M. Michna

(57) ABSTRACT

A well completion and related method are provided for formations susceptible to simultaneous production of oil and water. In one embodiment, two closely spaced, preferably horizontal wellbores are drilled from a single well into the reservoir. The reservoir rock surrounding one leg (typically the upper leg) is chemically treated to make it hydrophobic, whereas the reservoir rock surrounding the other leg is chemically treated to make it hydrophilic. Separate production tubing and a dual completion is installed in order to enable independent flow from each leg. Drawdown pressures in both legs are controlled to be sufficiently close to each other such that only oil flows into one leg and only water into the other. The water produced is re-injected downhole or brought to the surface.

28 Claims, 5 Drawing Sheets

(56) References Cited

U.S. PATENT DOCUMENTS

| | | | | |
|---|---|---|---|---|
| 6,125,936 | A * | 10/2000 | Swisher | 166/265 |
| 6,131,655 | A * | 10/2000 | Shaw | 166/105.5 |
| 6,227,286 | B1 | 5/2001 | Katsui | |
| 6,415,864 | B1 | 7/2002 | Ramakrishnan et al. | |
| 6,476,169 | B1 * | 11/2002 | Eoff et al. | 526/307.2 |
| 7,028,774 | B2 * | 4/2006 | Nguyen et al. | 166/295 |
| 7,934,557 | B2 * | 5/2011 | Nguyen | 166/295 |
| 8,459,352 | B1 * | 6/2013 | Kalman et al. | 166/250.01 |
| 2003/0106686 | A1 * | 6/2003 | Ingle et al. | 166/245 |
| 2006/0144589 | A1 * | 7/2006 | Manin et al. | 166/265 |
| 2007/0062697 | A1 * | 3/2007 | Barbosa et al. | 166/263 |
| 2009/0301726 | A1 * | 12/2009 | Coronado | 166/319 |
| 2010/0193193 | A1 * | 8/2010 | Wagg et al. | 166/311 |
| 2011/0048707 | A1 * | 3/2011 | Kalman et al. | 166/279 |
| 2011/0265994 | A1 * | 11/2011 | Entchev et al. | 166/270 |
| 2012/0222860 | A1 * | 9/2012 | Kalman et al. | 166/270 |

OTHER PUBLICATIONS

Kelland; Production Chemicals for the Oil & Gas Industry; 2009; CRC Press; pp. 1-415; http://yabc.ru/docs/3/2855/conv_1/file1.pdf.*

Jin; Downhole Water Loop (DWL) Well Completion for Water Coning Control—Theoretical Analysis; Dec. 2009; pp. 1-146; http://etd.lsu.edu/docs/available/etd-11112009-204537/unrestricted/Jin_thesis.pdf.*

International Search Report issued in PCT/US2012/032139 on Aug. 9, 2012, 2 pages.

Tweheyo, et al., "Simulations of Oil-Wet Membrane Wells for Water-Free Oil Production and Downhole Separation", SPE 81189—SPE Latin American and Caribbean Petroleum Engineering Conference, Port-of-Spain, Trinidad and Tobago, Apr. 27-30, 2003, pp. 1-11.

* cited by examiner

DUAL OR TWIN-WELL COMPLETION WITH WETTABILITY ALTERATION FOR SEGREGATED OIL AND WATER PRODUCTION

BACKGROUND OF THE INVENTION

1. Field of the Invention

This invention relates broadly to production of oil from formations. More particularly, this invention relates to dual completion systems and related methods for segregating oil and water downhole so that oil is produced separately from water.

2. State of the Art

At some time in the life of most wells, water is co-produced with hydrocarbons (e.g., oil). Lifting this water to the formation surface, separating it from the hydrocarbons, cleaning, and disposing it contribute to the costs of production operations. Moreover, because of issues related to two-phase flow (e.g. water and oil) in the wellbore, lifting of water along with oil may substantially reduce overall oil production. In addition, in some cases, regulatory restrictions call for treatment of water once it is brought up to the surface. Because of these considerations, various downhole oil-water separation (DHOWS) schemes have been proposed. None has been universally successful since all have technical and/or economical limitations.

One DHOWS scheme utilizes hydrocyclones. Reservoir simulation and economics studies suggest that DHOWS systems should be installed soon after water breakthrough when oil flow rates are still high and water rates low. Hydrocyclones, however, are not well-suited to situations in which the produced water fraction is small. In addition, hydrocyclones are often unreliable, particularly downhole.

In-well gravity separation is another DHOWS scheme which has been proposed. However, in-well gravity separation will not perform well at low water cuts or high water cuts, and therefore, this technique has not gained traction in the art. They also do not perform well for high flow rates due to viscous drag, and high crude oil viscosity where separation may be hindered.

Dual-drain completions that attempt to separately produce fluids that are already largely segregated by gravity within the reservoir have been proposed as a DHOWS scheme. See, e.g., co-owned U.S. Pat. No. 6,415,864 to Ramakrishnan et al. These completion systems work in conjunction with reservoir monitoring and control of the oil-water transition zone. In particular, these systems are best deployed with monitoring via a sensing mechanism for the oil-water transition around the wellbore. Because this is technologically intensive, costs are large, if not prohibitive.

A fourth proposed DHOWS scheme is disclosed in U.S. Pat. No. 4,296,810 to Price where membranes are suggested for oil-water separation. While membranes can facilitate the delay of the onset of water production, this approach is limited since naturally, a near-wellbore water-block will form and reduce oil production or allow water breakthrough to occur. Furthermore deployment of relatively fragile membranes while maintaining integrity has not been overcome.

SUMMARY OF THE INVENTION

In accord with the present invention, a dual completion wellbore is provided where the formation around part of the wellbore or an extension thereof is chemically treated to be hydrophobic and a closely spaced area of the formation around another part of the wellbore or an extension thereof is chemically treated to be hydrophilic. Perforations in the wellbore or its extensions are provided at the hydrophobic and hydrophilic formation locations and production tubing is provided so that oil and water independently flow through the perforations into the tubing and are separately produced.

In one embodiment, two closely spaced wellbore legs are drilled out from a single (main) wellbore. The formation around one of the closely spaced wellbore legs is chemically treated to be hydrophobic, and the formation around the other of the closely spaced wellbore legs is chemically treated to be hydrophilic. Separate production tubing or a dual completion is installed in order to enable independent flow from the closely spaced wellbore legs.

According to one embodiment, where closely spaced wellbore legs are utilized, the wellbore legs are horizontally oriented.

According to one embodiment, drawdown pressures in both legs are controlled to be sufficiently close to each other such that only oil flows into one leg and only water into the other.

According to another embodiment, the water produced in one leg is reinjected downhole.

The instant DHOWS invention is particularly economical when either the far-field is in a water-oil transition zone, or when an underlying water zone driven by an aquifer is likely to have a water cone advancing towards the oil-zone completion. Deployment is not recommended in what is known to be a pure hydrocarbon interval, where oil production occurs either by decompression or by a distant drive. However, for cases where a distant drive is the production mechanism, the invention becomes relevant once the water starts to rise near the wellbore.

Additional objects and advantages of the invention will become apparent to those skilled in the art upon reference to the detailed description taken in conjunction with the provided figures.

DETAILED DESCRIPTION OF THE PREFERRED EMBODIMENTS

As will be described in detail hereinafter, the invention involves a dual completion wellbore where the formation (reservoir rock) around part of the wellbore or an extension thereof is chemically treated to be hydrophobic and a closely spaced area of the formation around another part of the wellbore or an extension thereof is chemically treated to be hydrophilic. Perforations in the wellbore or its extensions are provided at the hydrophobic and hydrophilic formation locations and production tubing is provided so that oil and water independently flow through the perforations into the tubing and are separately produced.

Figure 1:
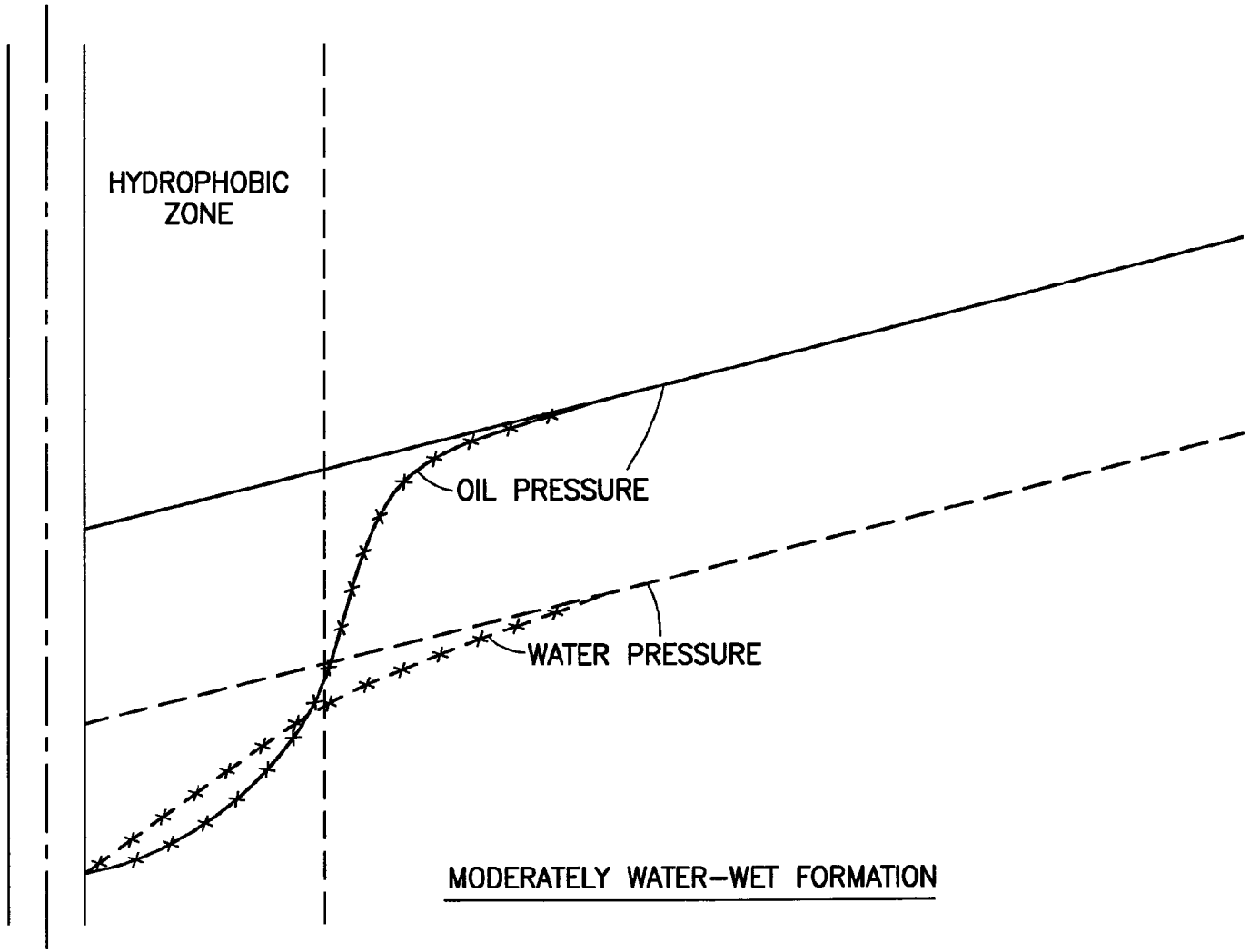
FIG. 1 is a diagram showing oil and water pressures at a single wellbore depth both in the absence of wellbore effects and in the presence of hydrophobic treatment.

In understanding the invention, it is useful to grasp the basics of the effect of making a region of a formation hydrophobic or hydrophilic. The situation where the far-field is in a zone capable of producing water and oil, both in moderate amounts, may be taken as an example. For the sake of illustration, it is assumed that the formation is homogeneous and mildly water-wet before any treatment. In such a situation it can be anticipated that the reservoir capillary pressure will be roughly a few times higher than the entry capillary pressure ($p_b$), but not significantly (i.e., factors of 10) higher. When there is a uniform flow of oil and water, pressure gradients in both phases occur. The pressure profiles at a single wellbore depth are illustrated in FIG. 1, where the solid and dashed lines are the (uniform) pressure for oil and water pressures respectively, with the gradients shown as though they are unaffected by the presence of the wellbore. The solid and dashed x-ed lines are the pressure for oil and water pressures respectively, with the profiles shown for the case when the wellbore is present with the treated hydrophobic zone around it. In order for simultaneous oil and water production to occur at the wellbore, the sand-face capillary pressure ($p_c$) is made zero for the x-ed lines.

If the near wellbore region is made hydrophobic, the relative permeability and the capillary pressure curves can be expected to go from a water-wet to a oil-wet behavior. It is difficult to precisely judge the magnitude of the change of the relative permeability curves without tracking all of the hysteresis issues. However, it can be assumed that the relative permeability to water will increase and the relative permeability to oil will decrease. Similarly, the capillary pressure curve will also shift below the $p_c=0$ axis with $p_c$ defined as the oil pressure minus the water pressure. As a result, it can be shown that upon treatment (i.e., when the near wellbore region is made hydrophobic), a zone radially outside of and adjacent the treatment area will develop where an anomalous water accumulation will result. Water and oil will continue to flow at the same rate as before, because at steady-state, this is dictated by the far-field. However, the near wellbore hydrophobicity results in an accumulation of the non-wetting phase of the treated zone (i.e., water) to form in front of the treated zone, ultimately leading to failure unless the blocked water is removed.

The converse situation is obtained when the near wellbore region is made hydrophilic. In particular, given the above-described assumptions it can be shown that when the near wellbore region is made hydrophilic, a zone in front of the treatment area will develop where an anomalous oil accumulation results. As a result, eventually, unless the blocked oil is removed, failure results. A facility to remove the oil is needed.

Figure 2:
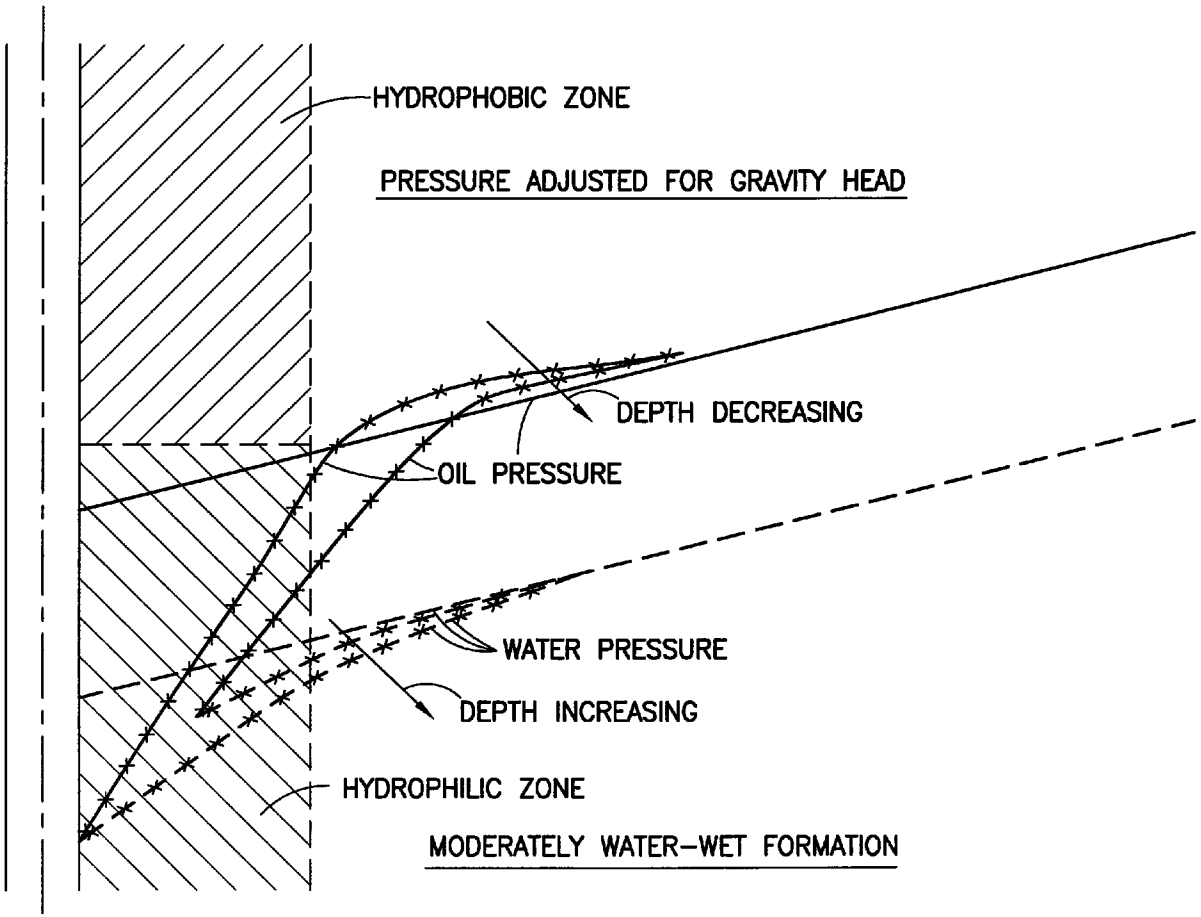
FIG. 2 is a diagram showing oil and water pressures at two wellbore depths both in the absence of wellbore effects and in the presence of hydrophobic and hydrophilic zones.
Figure 3:
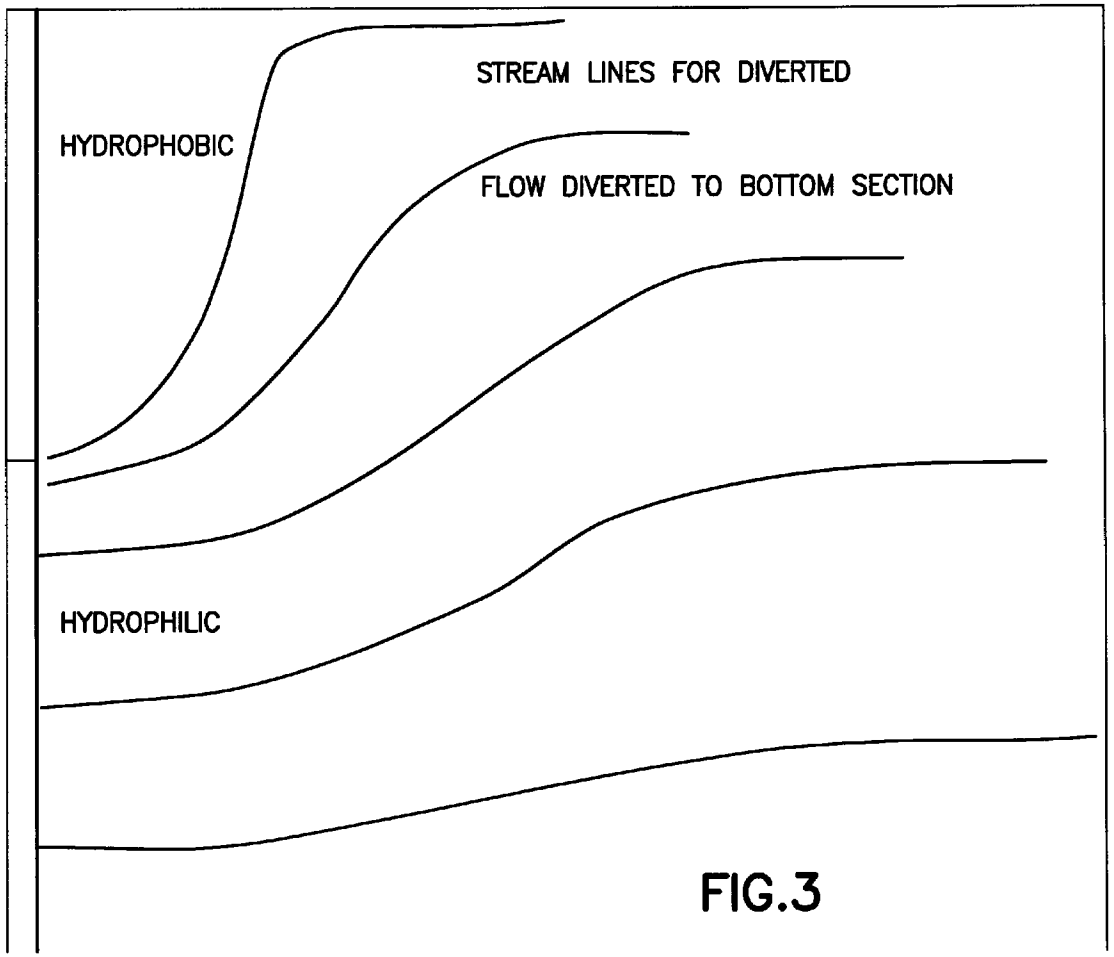
FIG. 3 is a diagram showing stream lines that illustrate diversion of water flow from a hydrophobic area to a hydrophilic area of a formation

FIG. 2 shows the pressure profiles of a system with a wellbore surrounded by an upper hydrophobic zone and a lower hydrophilic zone. In FIG. 2, the solid and dashed lines are the pressure (adjusted for gravity head) for oil and water pressures respectively, with the gradients shown as though they are unaffected by the presence of the wellbore. The solid and dashed x-ed lines are the profiles for oil and water pressures respectively at two different depths, with the gradients shown for the case when the wellbore is present with the treated hydrophobic and hydrophilic zones around it. The gravity head has been subtracted in these profiles. It should be noted that the lower pressure values for the oil pressure are at a decreased depth, whereas the lower pressure values for the water pressure are at an increased depth (see "depth decreasing" and "depth increasing" arrows). FIG. 3 shows the streamlines for water in such a system. As seen in FIG. 3, essentially all of the water flow from the far-field is channeled to the hydrophilic zone. Conversely, the oil flow (not shown in FIG. 3) is channeled to the hydrophobic zone. This arrangement will work for the separate production of oil and water provided the pressure difference between the two independent sections is kept small; i.e., the pressure difference is preferably smaller than twice the entry capillary pressure. If desired, the potentials corresponding to the streamlines for the oil and water at different depths can be generated.

Figure 4:
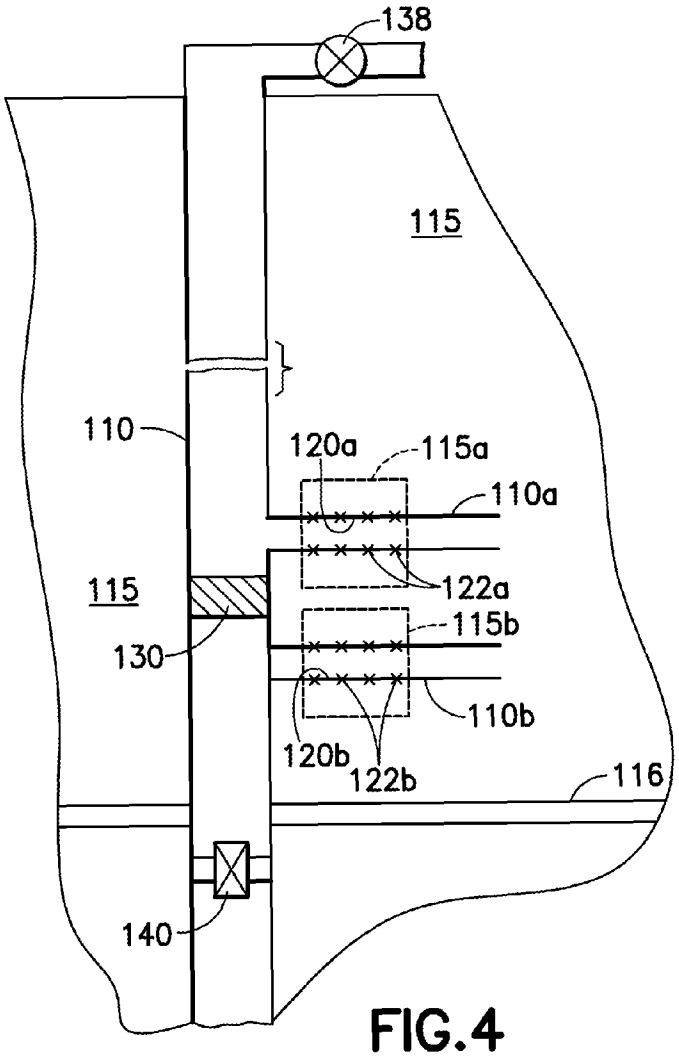
FIG. 4 is an illustration of a first embodiment of a DHOWS system according to the invention.

One embodiment of the invention is shown in FIG. 4, where two closely spaced wellbores 110*a*, 110*b* are drilled out as horizontal legs from a single mother wellbore 110 traversing a formation 115. The horizontal wellbores are preferably drilled roughly parallel and sufficiently close to each other that the wellbore pressure differences are less than approximately twice the entry capillary pressure of the rocks (for purposes herein, the word "approximately" shall mean within ten percent). Thus, for horizontal wells where the viscous pressure gradients are smaller than in vertical wells, the legs are preferably drilled within two and twenty meters of each other. Exact orientation, relative position, and location of wellbore legs 110*a*, 110*b* are all a matter requiring examination of the reservoir structure and flow parameters, but will suggest themselves to one skilled in the art based on the principles of the invention.

As seen in FIG. 4, wellbore leg 110*a* is completed with a casing 120*a*, with perforations 122*a* in the oil production interval, and wellbore leg 110*b* is completed with a casing 120*b* with perforations 122*b* in a water production interval, and separate "production" flowpaths are installed with means provided so that the pressures and flow rates in and from each leg may be separately controlled. Thus, a packer 130 may be installed in wellbore 110 at a location between the legs 110*a*, 110*b*, an uphole pump 138 provided to pump the production from leg 110*a*, and a downhole pump 140 provided to pump the production from leg 110*b* below a flow barrier 116 in the formation. Another manner of establishing separate flowpaths is described hereinafter with reference to FIG. 6. Regardless of the details of the flowpaths, as part of the completion operations, the reservoir rock 115*a* surrounding wellbore leg 110*a* is treated by injecting suitable chemicals to make it hydrophobic. The rock 115*b* surrounding wellbore leg 110*b* is treated by injecting suitable chemicals to make it hydrophilic. While any suitable chemicals may be utilized, and the specifics of the chemicals utilized is outside the scope of the invention, by way of example only, silicone or silanes (such as hexamethyldisilazane or bis(dimethylamino)dimethylsilane) for sandstone formations, or in the case of carbonate formations, napthenic acid solutions may be used as a hydrophobic agent, while aqueous cationic surfactant solutions for carbonates, and an anionic surfactant for sandstone formation may be used as a hydrophilic agent. The chemicals are preferably injected to a radial depth of between one and ten meters into the formation, and more preferably to a radial depth of between two and five meters, although it will be appreciated that the layer thickness of the producing formation can impact the radial depth of hydrophobic agent injection as can other factors such as cost.

Production, drawdown pressures are applied to both legs. Seen from large distances this creates a pressure sink within the reservoir causing both oil and water to flow towards the wellbore legs. The combination of near-wellbore wetting modification treatments, and controlled drawdowns in each leg permits oil to flow into the hydrophobically treated rock 115*a* surrounding a portion of wellbore leg 110*a* and thence into leg 110*a* for production uphole, and water to flow into the hydrophilically treated rock 115*b* surrounding a portion of wellbore leg 110*b* and thence into wellbore leg 110*b* for appropriate disposal. The oil production from leg 110*a* will be all or close to all oil because the water that flows with the oil from the bulk of the reservoir is held back by the hydrophobicity and preferentially flows into wellbore leg 110*a*. By allowing water to be continuously produced nearby into leg 110*b*, an increase in the water saturation near wellbore leg 110*a* and consequent decrease in the relative permeability to oil is avoided. Water accumulation induced blocking of oil is thus avoided. While water from wellbore leg 110*b* can be lifted to the surface for disposal (as described in the embodiment of FIG. 6), it is preferable to pump it further downhole for re-injection into the formation.

According to one aspect, the drawdown pressures in the two legs are controlled in a manner such that the difference between them does not exceed approximately twice the entry capillary pressure for the region. Controlling the drawdown pressures in this manner limits the difference in the oil and water flow rates. If desired, the drawdown pressures in the legs may be controlled on the basis of observations. For example, the desired oil flow rate may be maintained and the water leg may be adjusted so that pressures are sufficiently close to that of the oil leg. In other words, the water rate will be determined automatically when the oil rate is fixed via pressure proximity. The limit on the oil rate that may be obtained in this manner can be determined through simulations. As previously mentioned, the pressure difference between the legs of the wells should not be allowed to become too large since this could allow a nonwetting fluid to invade into the treated region.

Figure 5:
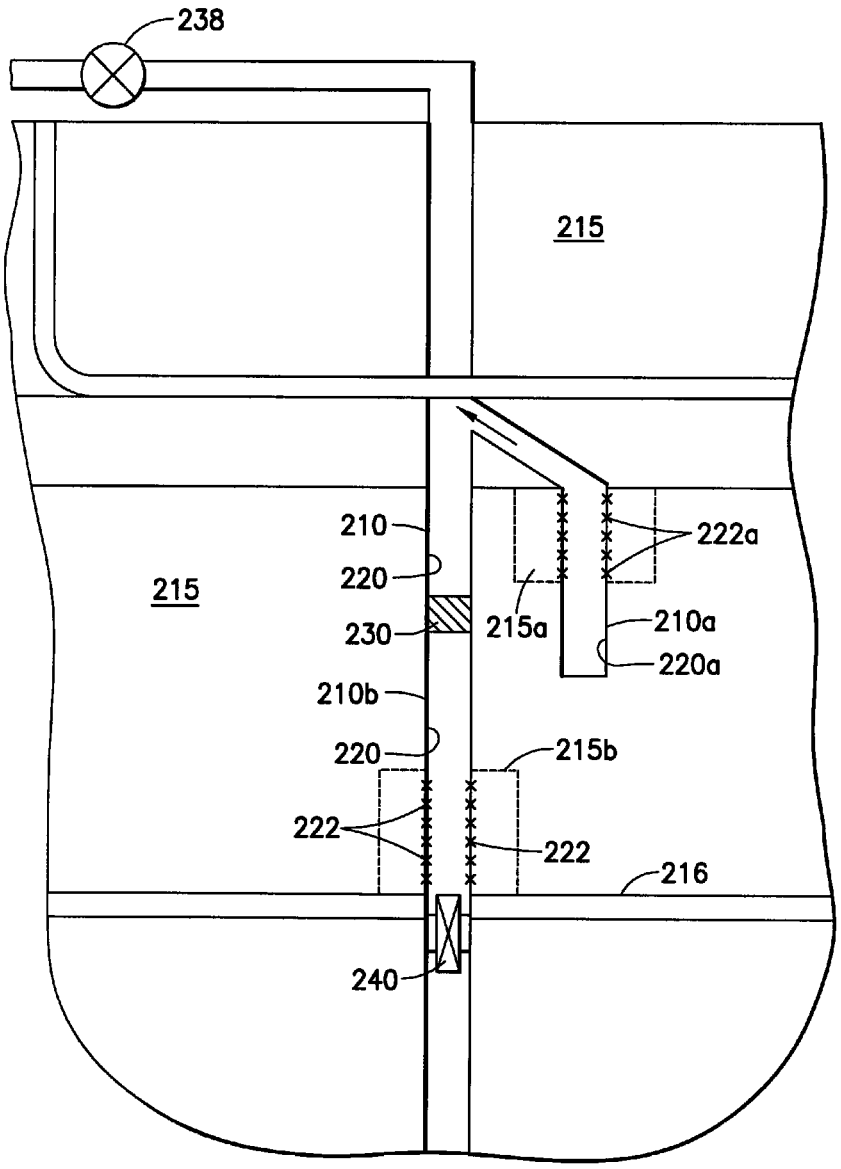
FIG. 5 is an illustration of a second embodiment of a DHOWS system according to the invention.

A second embodiment of the invention is shown in FIG. 5, where a closely spaced leg wellbore 210*a* is drilled out of formation 215 in the production zone and near the mother wellbore 210. The leg wellbore 210*a* is preferably drilled roughly parallel and sufficiently close to the mother wellbore 210 such that pressure differences are less than approximately twice the entry capillary pressure of the formation. In case the entry capillary pressure is substantially different in the two zones to be treated, it is preferably to keep the pressure difference less than twice the smaller of the two entry capillary pressures. Thus, the leg wellbore 210*a* is preferably drilled within twenty meters, more preferably within ten meters, and even more preferably within a few meters of the mother wellbore 210. The distance should not be too close to make it mechanically difficult to drill, and not too far that the reservoir properties become substantially different from those known from wellbore logs of the mother wellbore 210. Exact orientation, relative position, and location of wellbore leg 210*a* are all a matter requiring examination of the reservoir structure and flow parameters, but will suggest themselves to one skilled in the art based on the principles of the invention, e.g. through numerical simulation.

As seen in FIG. 5, the wellbore leg 210*a* and the mother wellbore 210 are completed with casings 220*a*, 220 which have perforations 222*a*, 222, and separate "production" flowpaths are installed with means provided as described above with reference to FIG. 4 so that the pressures and flow rates may be separately controlled. A packer 230 may be installed in the mother wellbore 210 at a location below the divergence of leg 210*a* from the mother wellbore 210 to effectively create a second leg 210*b*. An uphole pump 238 provided to pump the (oil) production from leg 210*a* uphole, and a downhole pump 240 provided to pump the (water) production from the "leg" portion 210*b* of the mother wellbore below the packer 230 to below a flow barrier 216 in the formation. If necessary the uphole pump 238 could be located within the wellbore, e.g. when the oil reservoir is under pressurized. Another manner of establishing separate flowpaths is described hereinafter with reference to FIG. 6. Regardless of the details of the flowpaths, as part of the completion operations, the reservoir rock 215*a* surrounding wellbore leg 210*a* is treated by injecting suitable chemicals to make it hydrophobic. The rock 215*b* surrounding the leg portion 210*b* of the mother wellbore 210 just below the oil production zone is treated by injecting suitable chemicals to make it hydrophilic.

In production, drawdown pressures are applied to wellbore leg 210*a* and leg portion 210*b* of the mother wellbore 210. Seen from large distances this creates a pressure sink within the reservoir causing both oil and water to flow towards the wellbores. The combination of near-wellbore wetting modification treatments, and controlled drawdowns in each leg permits oil to flow into the hydrophobically treated rock 215*a* surrounding a portion of wellbore leg 210*a* and thence into leg 210*a* for production uphole, and water to flow into the hydrophilically treated rock 215*b* surrounding portion 210*b* of the mother wellbore 210 and thence into leg portion 210*b* for appropriate disposal. The oil production from leg 210*a* will be all or close to all oil as the water that flows with the oil from the bulk of the reservoir is held back by the hydrophobicity and preferentially flows into wellbore leg 210*a*. By allowing water to be continuously produced nearby into leg portion 210*b* of the mother wellbore, any increase in the water saturation near wellbore leg 210*a* and consequent decrease in the relative permeability to oil is avoided. Water accumulation induced blocking of oil, which would occur if simultaneous production of water were not undertaken, is thus avoided. While water from wellbore portion 210*b* can be lifted to the surface for disposal (as described in the embodiment of FIG. 6), it is preferably to pump it further downhole for re-injection into the distant or stratigraphically different formation.

According to one aspect, the drawdown pressures in the legs 210*a* and 210*b* are controlled in a manner as described above with reference to FIG. 4.

Figure 6:
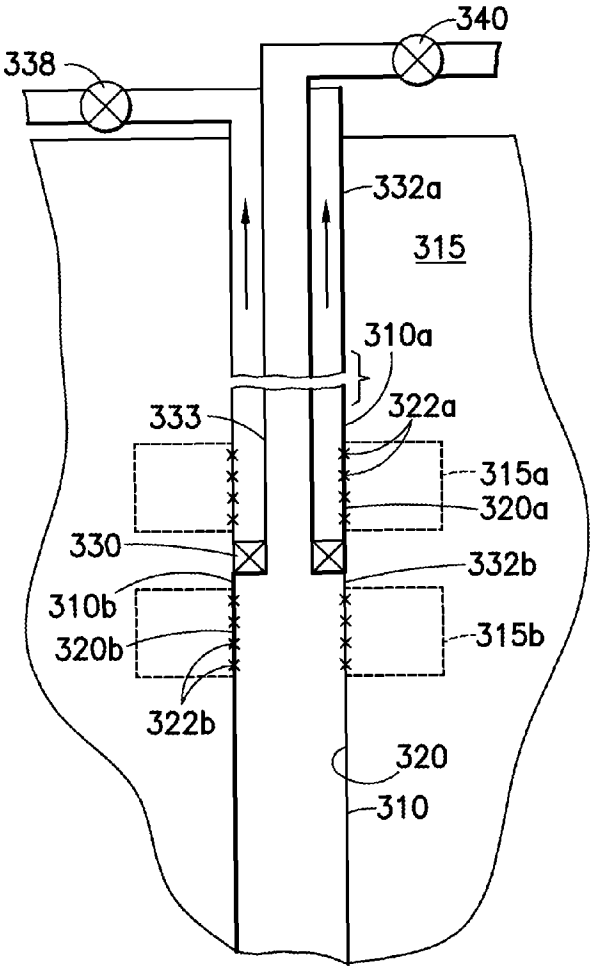
FIG. 6 is an illustration of a third embodiment of a DHOWS system according to the invention.

A third embodiment dual completion system is shown in FIG. 6 where a wellbore 310 is drilled out of formation 315. The wellbore 310 is completed with a casing 320 which has perforations 322*a*, 322*b* in casing portions 320*a*, 320*b* (adjacent wellbore portions 310*a*, 310*b*) located on either sides of a packer 330. Separate "production" flowpaths are installed. A first (oil) production flowpath includes an upper outer tube 332*a* which is in communication with perforations 322*a* in the casing 320*a*. A second (water) production flowpath includes a lower tube 332*b* which is in communication with perforations 322*b* in casing 320*b*, but which also has an upper portion 333 which extends through packer 330 and inside the outer upper tube 332*a*. A first uphole pump 338 is provided to pump the (oil) production from wellbore portion 310*a* uphole, and a second uphole pump 340 is provided to pump the (water) production from the wellbore portion 310*b* of the wellbore below the packer 330 uphole. These pumps may also be located downhole in the respective sections and may be required to be so for under-pressurized reservoirs. Regardless of the details of the flowpaths, as part of the completion operations, the reservoir rock 315*a* surrounding wellbore portion 310*a* is made hydrophobic by injecting suitable chemicals. The rock 315*b* surrounding the wellbore portion 310*b* is made hydrophilic through chemical treatment also.

In production, drawdown pressures are applied to wellbore portion 310*a* and wellbore portion 310*b*. Seen from large distances this creates a pressure sink within the reservoir resulting in both oil and water flow towards the wellbore. The combination of near-wellbore wetting modification treatments and controlled drawdown in each wellbore portion, permits oil to flow into the hydrophobically treated rock 315*a* surrounding a wellbore portion 310*a* for production uphole, and water to flow into the hydrophilically treated rock 315*b* surrounding wellbore portion 310*b* for appropriate disposal. The oil production from wellbore 310*a* will be all or close to all oil as the water that flows with the oil from the bulk of the reservoir is held back by the hydrophobicity and preferentially flows into wellbore portion 310*a*. By allowing water to be continuously produced nearby into wellbore portion 310*b*, any increase in the water saturation near wellbore portion 310*a* and consequent decrease in the relative permeability to oil is avoided. The blocking of oil due to water accumulation is avoided through simultaneous production of water. While water from wellbore portion 310*b* is shown being lifted to the surface for disposal, the production paths may be modified to the paths discussed above with reference to FIGS. 4 and 5, and the water may be pumped downhole for re-injection into the distant or stratigraphically different formation.

According to one aspect, the drawdown pressures in the wellbore portions 310*a* and 310*b* are controlled in a manner as described above with reference to FIG. 4.

While all of the embodiments have been described as having wellbores that are completed with perforated casings, it will be appreciated by those skilled in the art that the invention also applies to wellbores that have "barefoot completions" as well as wellbores that are completed with slotted sleeves. In fact, it is possible that completions could involve a combination of technologies; by way of example only, a slotted sleeve completion for one portion of the wellbore (or extension thereof), and a casing completion with perforations in another portion of the wellbore (or extension thereof). Regardless, for each situation, what is required is that the identified portions of the wellbore or extensions thereof be isolated so that independent production of oil from the area of the formation treated with hydrophobic agent through one portion of the wellbore (or extension) and water from the area of the formation treated with the hydrophilic agent through another portion of the wellbore (or extension) may be accomplished.

It will also be appreciated that while all of the embodiments have been described as utilizing pumps (uphole and/or downhole) to control pressures and flow rates, other means are well-known for such control. By way of example only, in certain circumstances, instead of using pumps, "intelligent completion" throttle valves may be located downhole, with the size of the opening controlled for pressure and flow. Alternatively, throttle valves may be located at the surface of the formation.

There have been described and illustrated herein downhole oil-water separation systems and methods. While particular embodiments have been described, it is not intended that the invention be limited thereto, as it is intended that the invention be as broad in scope as the art will allow and that the specification be read likewise. While a second embodiment was shown where a formation portion surrounding a wellbore leg drilled from the mother wellbore was treated with hydrophobic chemicals and another formation portion surrounding a portion of the mother wellbore was treated with hydrophilic chemicals, it will be appreciated that the treatment could have been reversed; i.e., with the hydrophilic treatment of the formation surrounding the deeper wellbore leg drilled from the mother wellbore and the hydrophobic treatment of the formation portion surrounding the mother wellbore. Further, it should be appreciated that various aspects of one embodiment can be used in conjunction with other embodiments. For example, water produced through the hydrophilic zone of any of the embodiments may be either produced to the surface or pumped to another location in the well (typically lower down) and reinjected into the formation. As another example, while horizontal and vertical "leg" wellbores have been described, the wellbores or wellbore portions may take any of many different orientations (e.g., angled) depending upon the geography of the formation. It will therefore be appreciated by those skilled in the art that yet other modifications could be made to the provided invention without deviating from its spirit and scope as claimed.

What is claimed is:

1. A method, comprising:

completing a wellbore located in a formation by isolating a first portion of the wellbore or extension thereof from a second portion of the wellbore or extension thereof, said second portion of the wellbore or extension thereof being located within twenty meters of the first portion of the wellbore or extension thereof, and said first portion of said wellbore or extension thereof being located at a hydrocarbon producing location of the formation;

chemically treating a first portion of the formation adjacent said first portion of the wellbore or extension thereof to make said first portion of the formation hydrophobic, wherein the chemical treatment of the first portion extends a radial depth of between one and ten meters into the formation;

chemically treating a second portion of the formation adjacent said second portion of the wellbore or extension thereof to make said second portion of the formation hydrophilic, wherein the chemical treatment of the second portion extends a radial depth of between one and ten meters into the formation;

simultaneously and separately producing hydrocarbons from said first portion of the wellbore or extension thereof and water from said second portion of the wellbore or extension thereof; and separately bringing said hydrocarbons to a surface of the formation.

2. A method according to claim 1, further comprising:

disposing said water by directing and injecting said water into a different portion of said formation below a flow barrier in the formation.

3. A method according to claim 1, further comprising:

separately bringing said water to the surface of the formation.

4. A method according to claim 1, wherein:

said simultaneously and separately producing comprises controlling wellbore pressures at said first portion of the wellbore or extension thereof or said second portion of the wellbore or extension thereof so that wellbore pressure differences thereat are less than approximately twice an entry capillary pressure of said formation.

5. A method according to claim 4, wherein:

said completing comprises providing first piping for said hydrocarbons and a first pressure control means coupled to said first piping, and providing separate second piping for said water and a second pressure control means coupled to said second piping.

6. A method according to claim 5, wherein:

said first pressure control means comprises a first pump located downhole or on the surface of the formation, and said second pressure control means comprises a second pump located downhole or on the surface of the formation.

7. A method according to claim 6, wherein:

said first pressure control means comprises a first throttle valve, and said second pressure control means comprises a second throttle valve.

8. A method according to claim 5, wherein:

said completing further comprises providing a packer between said first piping and said second piping.

9. A method according to claim 1, wherein:

said first portion of the wellbore or extension thereof is a first substantially horizontal wellbore leg extension of the wellbore, and said second portion of the wellbore or extension thereof is a second substantially horizontal wellbore leg extension of the wellbore, said first and second horizontal wellbore leg extensions extending substantially parallel to each other.

10. A method according to claim 9, wherein:

said first substantially horizontal wellbore leg extension is located above said second substantially horizontal wellbore leg extension.

11. A method according to claim 1, wherein:

said first portion of the wellbore or extension thereof is a wellbore leg extension of the wellbore, and said second portion of the wellbore or extension thereof is a second part of the wellbore.

12. A method according to claim 1, wherein:

said first portion of the wellbore or extension thereof is a first part of the wellbore, and said second portion of the wellbore or extension thereof is a wellbore leg extension of the wellbore.

13. A method according to claim 1, wherein:

said first portion of the wellbore or extension thereof is a first part of the wellbore, and said second portion of the wellbore or extension thereof is a second part of the wellbore.

14. A method according to claim 1, wherein:

said completing further comprises providing one of (i) a casing and a first set of perforations in the casing and (ii) a sleeve with first slots, located within said first portion of the wellbore or extension thereof.

15. A method according to claim 14, wherein:

said completing further comprises providing a casing and a second set of perforations in the casing within a second portion of the wellbore or extension thereof.

16. A wellbore completion system for a formation having a wellbore located in the formation and having a first wellbore portion or leg extension located in a producing region of the formation and a second wellbore portion or leg extension located within twenty meters of said first wellbore portion or leg extension, the completion system comprising:

hydrophobic material which has been injected into a first portion of said formation adjacent said first wellbore portion or leg extension to make said first portion of said formation hydrophobic, wherein the hydrophobic material extends a radial depth of between one and ten meters into the formation;

hydrophilic material which has been injected into a second portion of said formation adjacent said second wellbore portion or leg extension to make said second portion of said formation hydrophilic, wherein the hydrophilic material extends a radial depth of between one and ten meters into the formation;

first piping in fluid communication with said first wellbore portion or leg extension and extending to a surface of the formation, and a first pressure control means coupled to said first piping, said first piping adapted to direct hydrocarbons from said first wellbore portion or leg extension to a surface of the formation;

second piping in fluid communication with said second wellbore portion or leg extension, and a second pressure control means coupled to said second piping, said second piping adapted to separately direct water entering said second piping, wherein said first pressure control means and said second pressure control means are adapted to simultaneously and separately produce hydrocarbons and water from the formation.

17. A wellbore completion system according to claim 16, wherein said first pressure control means and said second pressure control means are adapted to control wellbore pressures at said first wellbore portion or leg extension and said second wellbore portion or leg extension so that wellbore pressure differences thereat are less than approximately twice a minimum entry capillary pressure of said formation.

18. A wellbore completion system according to claim 16, further comprising:

a packer separating said first piping and said second piping.

19. A wellbore completion system according to claim 16, wherein:

said first wellbore portion or leg extension comprises a first leg extension and said second wellbore portion or leg extension comprises a second leg extension, and said first leg extension and said second leg extension are substantially horizontally oriented and parallel to each other.

20. A wellbore completion system according to claim 16, further comprising:

a first casing located in said first leg extension and a first set of perforations in the first casing, and a second casing located in said second leg extension and a second set of perforations in the second casing.

21. A wellbore completion system according to claim 16, further comprising:

a first slotted sleeve located in said first leg extension and a second slotted sleeve located in said second leg extension.

22. A wellbore completion system according to claim 16, wherein:

said first pressure control means is a first pump, and said second pressure control means is a second pump.

23. A wellbore completion system according to claim 22, wherein:

at least one of said first pump and second pump is located downhole.

24. A wellbore completion system according to claim 23, wherein:

said second pump is located downhole and adapted to pump water further downhole away from the surface of said formation.

25. A wellbore completion system according to claim 16, wherein:

said first pressure control means comprises a first throttle valve, and said second pressure control means comprises a second throttle valve.

26. A wellbore completion system according to claim 16, wherein:

said first wellbore portion or leg extension comprises a first leg extension, and said second wellbore portion or leg extension comprises a part of the wellbore, said first leg extension and said part of the wellbore being substantially parallel to each other.

27. A wellbore completion system according to claim 26, further comprising:

a first casing located in said first leg extension and a first set of perforations in the first casing, and a second casing located in said part of the wellbore and a second set of perforations in the second casing.

28. A wellbore completion system according to claim 26, further comprising:

a first slotted sleeve located in said first leg extension.

* * * * *